US009423121B2

(12) United States Patent
Masuda et al.

(10) Patent No.: US 9,423,121 B2
(45) Date of Patent: Aug. 23, 2016

(54) SUPERHEATED-STEAM GENERATOR DEVICE

(71) Applicant: MASDAC CO., LTD., Tokorozawa-shi, Saitama (JP)

(72) Inventors: Fumiharu Masuda, Tokorozawa (JP); Shuichi Sanda, Tokorozawa (JP); Takeshi Hayano, Tokorozawa (JP); Tadashi Yamamoto, Osaka (JP); Masanori Arakawa, Osaka (JP)

(73) Assignee: MASDAC CO., LTD., Saitama (JP)

( * ) Notice: Subject to any disclaimer, the term of this patent is extended or adjusted under 35 U.S.C. 154(b) by 468 days.

(21) Appl. No.: 14/085,400

(22) Filed: Nov. 20, 2013

(65) Prior Publication Data

US 2014/0301723 A1 Oct. 9, 2014

(30) Foreign Application Priority Data

Apr. 9, 2013 (JP) ..... 2013-081171

(51) Int. Cl.
*F22B 1/28* (2006.01)
*F22G 1/16* (2006.01)

(52) U.S. Cl.
CPC ..... *F22B 1/282* (2013.01); *F22G 1/165* (2013.01)

(58) Field of Classification Search
CPC combination set(s) only.
See application file for complete search history.

(56) References Cited

FOREIGN PATENT DOCUMENTS

JP 2004-24322 1/2004

*Primary Examiner* — Dana Ross
*Assistant Examiner* — Renee L Larose
(74) *Attorney, Agent, or Firm* — Greer, Burns & Crain, Ltd.

(57) ABSTRACT

Provided is a superheated-steam generator device, in which the steam-loop-back structure of a steam-heating pipe is simplified and heaters can be individually attached to or removed from the device. The device includes a first disc, a second disc, a third disc, a fourth disc, and a fifth disc; multiple through-holes respectively are provided to the first disc, the third disc, and the fourth disc; at least one long through-hole and one through-hole are provided to the second disc; multiple steam-heating pipes are attached to the through-holes of the third disc and to the through-holes of the fourth disc; loop-back grooves and one through-hole are provided to the fifth disc; heaters that have spiral fins are attached into the through-hole of the first disc so as to cover the through-hole of the first disc; a steam-supply pipe; and a steam-discharge pipe.

2 Claims, 3 Drawing Sheets

SUPERHEATED-STEAM GENERATOR DEVICE

TECHNICAL FIELD

The present invention relates to a superheated-steam generator device, and more particularly to a superheated-steam generator device that includes a steam-heating pipe that has a simple, steam-loop-back structure, and that allows heaters to be individually attached to or removed from said device.

BACKGROUND

Superheated steam is steam obtained by further heating steam that is at 100° C. For example, a superheated-steam oven cooks foodstuffs by directly blowing superheated steam to the foodstuffs so as to bake them. The food-cooking apparatus disclosed in JP-A-2004-24322 connects multiple steam-heating pipes, into each of which a heater is inserted, with short non-heating pipes. The food-cooking apparatus disclosed in that prior-art document has the following characteristics: (1) because there is only a small space in the food-cooking apparatus, it is difficult to weld the short non-heating pipes onto the steam-heating pipes; (2) in order to connect the short non-heating pipes to the steam-heating pipes, holes must be drilled in the steam-heating pipes; and (3) the food-cooking apparatus is generally box-shaped, having a large width and a large depth despite having a low height. Therefore, if the food-cooking apparatus (i.e., superheated-steam generator) is to be formed into a cylindrical shape like a device, the welding of the short non-heating pipes onto the steam-heating pipe is very difficult.

PRIOR ART DOCUMENTS

Patent Documents

[Patent Document 1] JP-A-2004-24322

SUMMARY

Technical Problem To Be Overcome

Because the prior-art is such that it is difficult to form a superheated-steam generator into a cylindrical shape like a device, what has been needed is a superheated-steam generator device that has a simple, steam-loop-back structure and that connects multiple steam-heating pipes, into each of which can be inserted a heater that has short non-heating pipes and hence does not need separate short non-heating pipes, which are difficult to connect to the steam-heating pipe

Solution to the Problem

The superheated-steam generator device of the present invention includes a first disc, a second disc, a third disc, a fourth disc, and a fifth disc; the first disc, the third disc, and the fourth disc all have multiple through-holes that are arranged so as to be aligned along the same axis; the second disc has at least one long through-hole (7) and a through-hole (6*a*), and the long through-hole (7) interconnects two of the through-holes of the first disc with two of the through-holes of the third disc, and the through-hole (6*a*) interconnects one of the through-holes of the first disc with one of the through-holes of the third disc; multiple steam-heating pipes are attached to the third disc at the front end of each steam-heating pipe and are attached to the fourth disc at the back end of each steam-heating pipe; the fifth disc has at least one loop-back groove and a through-hole (6*b*), with the loop-back groove being dug so as to interconnect two of the through-holes of the fourth disc, and the through-hole (6*b*) aligns with one of the through-holes of the fourth disc; a heater having spiral fins is inserted through the through-hole of the first disc, with the attaching part (12) of the heater being screwed into the through-hole of the first disc so as to cover that through-hole; a steam-supply pipe is connected to one of the through-holes of the first disc so as to feed steam into the through-hole (6*a*) of the second disc; and a steam-discharge pipe is connected to the fifth disc so as to align with the through-hole (6*b*) of the fifth disc.

The attaching part (12) has a gap such that the inside of the center hole of the fastening part (12*a*) is separated from the main tube (19) of the heater.

Advantageous Effects

The superheated-steam generator device of the present invention includes a first disc, a second disc, and a third disc, with the second disc having long through-holes that respectively interconnect two through-holes of the first disc with two through-holes of the third disc, whereby little space is required to loop back heated steam in the device, without using short pipes. Each heater has an attaching part that is screwed into the through-hole of the first disc, and therefore the heater can easily be attached to or removed from the device. Accordingly, if the superheated-steam generator device stops functioning properly due to one defective heater, only that one heater need be replaced. Spiral fins that have large surface areas are in contact with the steam, so that the fins effectively heat the steam.

The attaching part is configured such that a gap is made between the center hole of the fastening part and the main tube of the heater, whereby transfer of heat from the fastening part to the main tube is prevented, the heat of the main tube is released from the gap, and the thermal effect on a feeder cable of the heat generated by the heater 11 is reduced.

BRIEF DESCRIPTIONS OF THE DRAWINGS

DETAILED DESCRIPTION

With reference to the accompanying drawings, an exemplary embodiment of the present invention is described below.

Example

Figure 1:
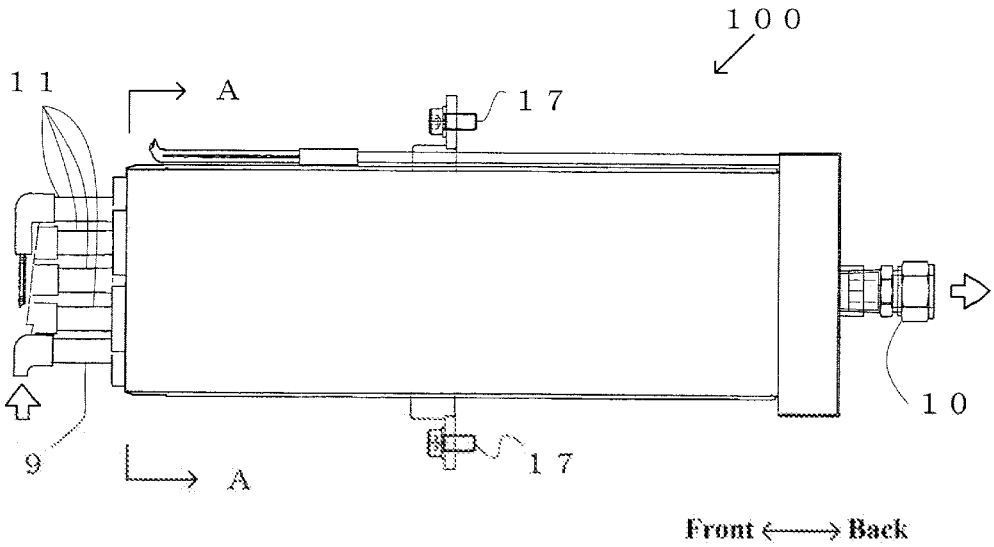
FIG. 1 is a front view of a superheated-steam generator device of the present invention.

FIG. 1 is a front view of a superheated-steam generator device of the present invention. The superheated-steam generator device 100 is cylindrical, and steam is supplied from a steam-supply pipe 9 at the front of the superheated-steam generator device 100 (the left side in FIG. 1), is heated by a heater 11, and is discharged into an oven via a steam-discharge pipe 10 at the back of the superheated-steam generator device 100 (the right side in FIG. 1). The superheated-steam generator device 100 is mounted to an oven wall using mounting screws 17. The superheated-steam generator device 100 is about 50 centimeters long, and has a diameter of about 11 centimeters.

Figure 2:
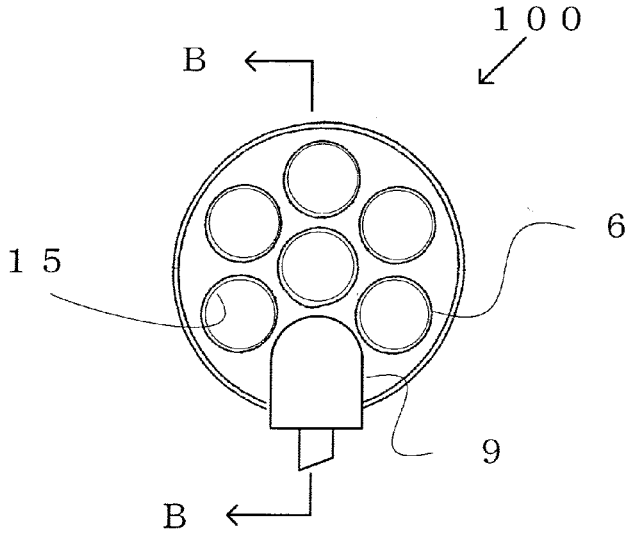
FIG. 2 is a side view along arrows A-A in FIG. 1, of the superheated-steam generator device from which heaters have been removed.

FIG. 2 is a side view of the superheated-steam generator device from which heaters have been removed, viewed along the arrows A-A in FIG. 1. The side of the device, which is round, has seven through-holes 6, each of which has an internal screw thread 15.

Figure 3:
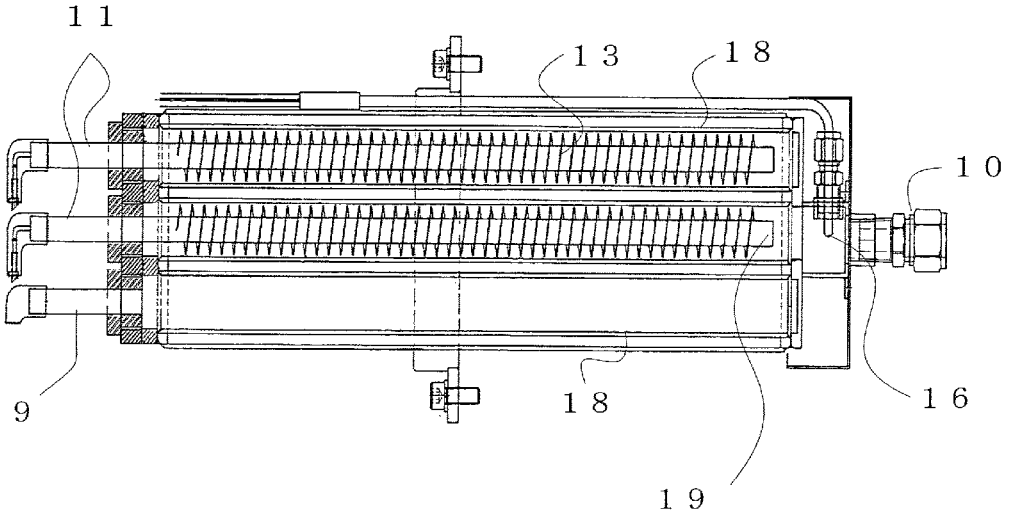
FIG. 3 is a cross-sectional view taken along line B-B of FIG. 2.

FIG. 3 is a cross-sectional view taken in the line B-B of FIG. 2. The heaters 11 are electric heaters. and each heater 11 has a feeder cable 12*d* on the left (shown in FIG. 5). The main tube 19 of the heater 11 is long and narrow and is inserted into and attached to a steam-heating pipe 18. The main tube 19 has spiral fins 13 that have large surface areas in contact with the steam that is injected into the steam-heating pipe 18, thereby improving the heating efficiency of the steam-heating pipe 18. The steam supplied from the steam-supply pipe 9 moves to the right through the steam-heating pipe 18 and then turns back to the left. This movement of the steam is repeated seven times, and then the steam is fed into the oven via the steam-discharge pipe 10. A temperature sensor 16 is provided at the discharging outlet of the steam-discharge pipe 10, whereby the temperature of the steam can be measured.

Figure 4:
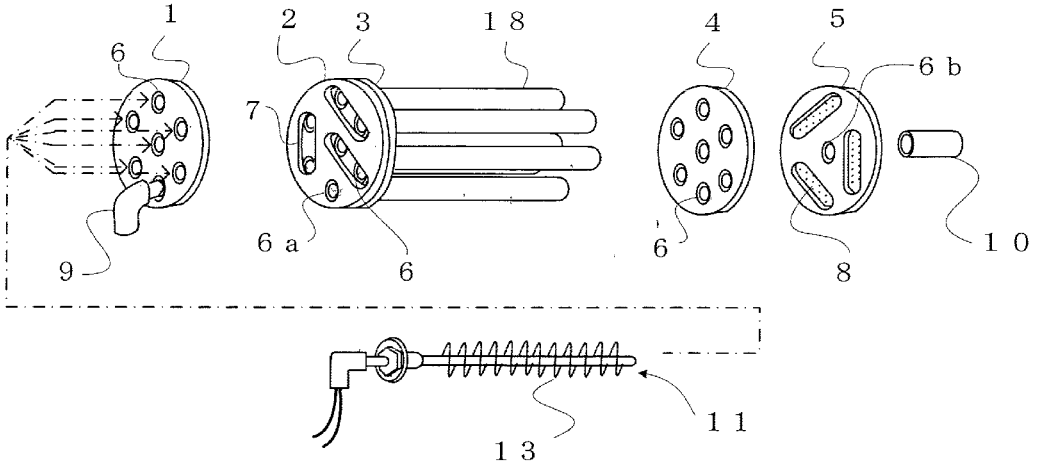
FIG. 4 is an exploded perspective view of the components of the superheated-steam generator device of the present invention.

FIG. 4 is an exploded perspective view of the components of the superheated-steam generator device of the present invention. The front of the superheated-steam generator device 100 has a first disc 1, a second disc 2, and a third disc 3, and the back of the superheated-steam generator device 100 has a fourth disc 4 and a fifth disc 5. The first disc 1, the third disc 3, and the fourth disc 4 have odd numbers of multiple through-holes 6, which are arranged so as to be aligned along the same axis. The second disc 2 has multiple, for example, three, long through-holes 7, through each of which two of the through-holes 6 of the first disc 1 and two of the through-holes 6 of the third disc 3 are interconnected. If there are three steam-heating pipes 18, the number of the long through-hole 7 may be one. Also, the second disc 2 has a through-hole 6*a* through which one of the through-holes 6 of the first disc 1 and one of the through-holes 6 of the third disc 3 are interconnected.

The steam-heating pipe 1 is welded to the through-holes 6 of the third disc 3 at its front end, and is welded to the through-holes 6 of the fourth disc 4 at its back end. The fifth disc 5 has a loop-back groove 8, which is dug so as to interconnect two of the through-holes 6 of the fourth disc 4. Also, the fifth disc 5 has a through-hole 6*b,* which aligns with one of the through-hole 6 of the fourth disc 4. In this example, there are seven steam-heating pipes 18.

The heater 11 is inserted through the through-hole 6 of the first disc 1, in which through-hole 6 an attaching part 12 is screwed. Therefore, the heaters 11 can be individually attached to or removed from the device. The heater 11 has spiral fins 13 that have large surface areas in contact with the steam. The heater 11 is attached to the inside of the steam-heating pipe 18 so as to directly heat the steam that passes through the steam-heating pipe 18. In this example, there are six heaters 11.

The steam-supply pipe 9 is connected to one of the through-holes 6 of the first disc 1 so as to feed the steam to the through-hole 6*a* of the second disc 2. The steam goes through the through-hole 6 of the third disc 3 at the six o'clock position, passes through the steam-heating pipe 18, and arrives at the through-hole 6 of the fourth disc 4 at the six o'clock position, and then is turned back at the loop-back groove 8 of the fifth disc 5. Subsequently, the steam goes through the through-hole 6 of the fourth disc 4 at the eight o'clock position, passes through the steam-heating pipe 18, and arrives at the through-hole 6 of the third disc 3 at the eight o'clock position, and is turned back at the long through-hole 7 of the second disc 2. This movement of the steam is repeated, and the steam is finally fed into the oven via the steam-discharge pipe 10, which is configured so as to align with the through-hole 6*b* in the center of the fifth disc 5.

Figure 5:
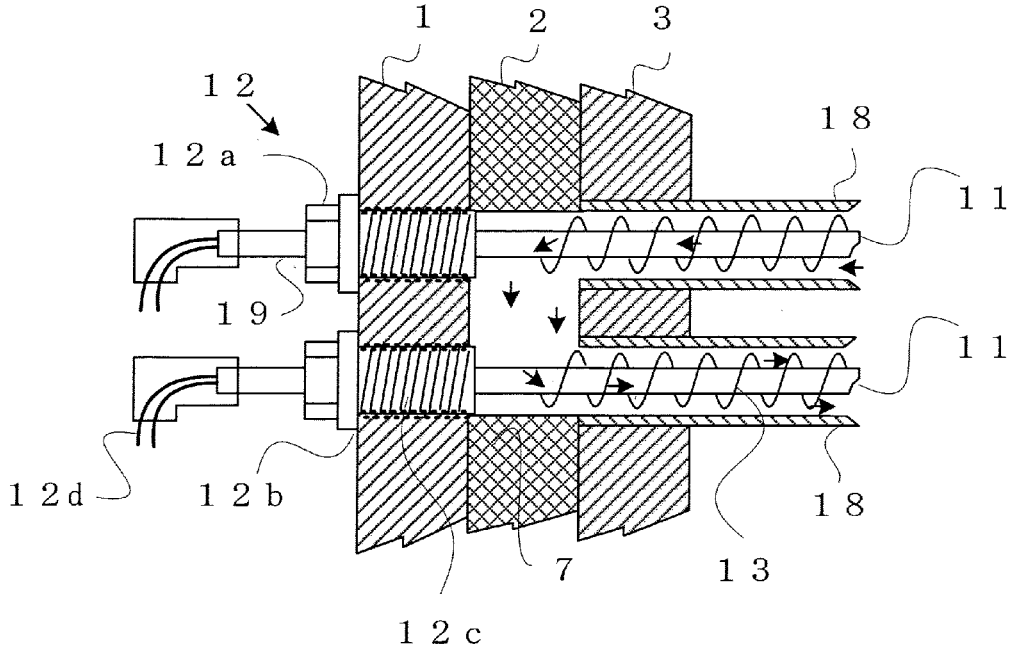
FIG. 5 is a schematic view showing the structure constituted by the first through third discs of FIG. 4 for looping back steam.

FIG. 5 is a schematic view showing the loop-back structure constituted by the first through third discs of FIG. 4 for looping back steam. The long through-hole 7 of the second disc 2 is constituted so as to interconnect two through-holes 6 of the first disc 1 with two through-holes 6 of the third disc 3, and the through-holes 6 of the first disc are covered by the attaching parts 12 of the heaters 11. Therefore, the steam returning from the back to the front of the steam-heating pipe 18 is turned back to the back of that pipe. The attaching part 12, which is attached to one end of the main tube 19, consists of a fastening part 12*a,* a flange 12*b,* and a screw part 12*c* that are integrally formed. The male screw of the screw part 12*c* is screwed to the female screw of the through-hole 6 of the first disc 1. At the center of the attaching part 12 is a center hole through which the main tube 19 penetrates and in which the flange 12*b* and the screw part 12*c* are joined to the main tube 19 and are sealed so that steam does not leak from the steam-heating pipe 18. Also, the fastening part 12*a* has a predetermined gap between the center hole and the outside of the main tube 19, whereby the heat of the heater 11 transferred to the fastening part 12*a* is released to the outside so that very little heat is conducted to the feeder cable 12*d.*

Figure 6:
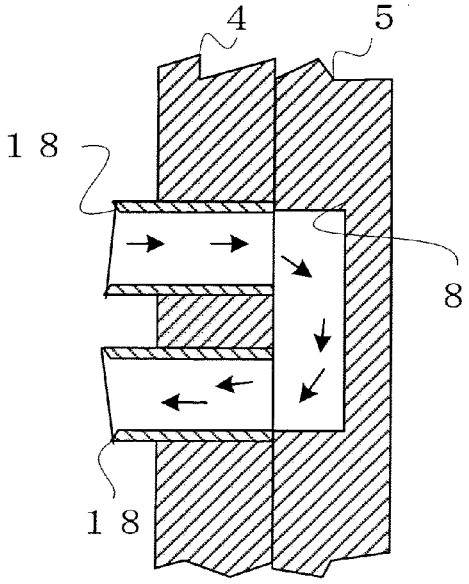
FIG. 6 is a schematic view showing the structure constituted by the fourth and fifth discs of FIG. 4 for looping back steam.

FIG. 6 is a schematic view showing the structure constituted by the fourth and fifth discs of FIG. 4 for looping back steam. The steam is turned back at the loop-back groove 8 of the fifth disc 5.

The number of steam-heating pipes 18 is not limited to seven as in the above example, but, for example, can be increased to nine or decreased to five. Also, the number of heaters 11 is not limited to six as in the above example, which number is one less than the number of the steam-heating pipes 18, but may be increased to seven. In such a case, it is necessary only to drill eight through-holes 6 in the first disc 1, and to modify the through-hole 6*a* of the second disc 2 into a long through-hole 7. However, if the outer diameter of the superheated-steam generator device is not enlarged, it is necessary to decrease the diameter of the through-hole 7, which increases the number of heaters using small-diameter heaters.

INDUSTRIAL APPLICABILITY

The present invention provides a compact superheated-steam generator device having a simple loop-back structure.

The invention claimed is:

1. A superheated-steam generator device, comprising:

a first disc, a second disc, a third disc, a fourth disc, and a fifth disc;

multiple through-holes that are provided to the first disc, the third disc, and the fourth disc, with the through-holes being arranged so as to be aligned along the same axis;

at least one long through-hole and a through-hole, those being provided to the second disc, with the long through-hole interconnecting two of the through-holes of the first disc with two of the through-holes of the third disc, and the through-hole interconnecting one of the through-holes of the first disc with one of the through-holes of the third disc;

multiple steam-heating pipes that are attached to the third disc at the steam-heating pipe's front end and attached to the fourth disc at the steam-heating pipe's back end;

at least one loop-back groove and a through-hole provided to the fifth disc, with the loop-back groove being dug so as to interconnect two of the through-holes of the fourth disc, and the through-hole aligning with one of the through-holes of the fourth disc;

a heater that has spiral fins and that is inserted through the through-hole of the first disc, with the attaching part of the heater being screwed on the through-hole of the first disc so as to cover the through-hole of the first disc;

a steam-supply pipe that is connected to one of the through-holes of the first disc so as to feed the steam to the through-hole of the second disc; and a steam-discharge pipe connected to the fifth disc so as to align with the through-hole of the fifth disc.

2. The superheated-steam generator device according to claim 1, and wherein the attaching part has a gap made such that the inside of the center hole of the fastening part is separated from a main tube of the heater.

* * * * *